US011619453B2

(12) United States Patent
Jiang et al.

(10) Patent No.: US 11,619,453 B2
(45) Date of Patent: Apr. 4, 2023

(54) MICROCHANNEL FLAT TUBE AND MICROCHANNEL HEAT EXCHANGER

(71) Applicant: HANGZHOU SANHUA RESEARCH INSTITUTE CO., LTD., Hangzhou (CN)

(72) Inventors: Haobo Jiang, Coconut Creek, FL (US); Li-Zhi Wang, Hangzhou (CN); Jian-Long Jiang, Hangzhou (CN); Lin-Jie Huang, East Amherst, NY (US)

(73) Assignee: HANGZHOU SANHUA RESEARCH INSTITUTE CO., LTD., Hangzhou (CN)

( * ) Notice: Subject to any disclaimer, the term of this patent is extended or adjusted under 35 U.S.C. 154(b) by 109 days.

(21) Appl. No.: 17/033,762

(22) Filed: Sep. 26, 2020

(65) Prior Publication Data

US 2021/0033350 A1 Feb. 4, 2021

Related U.S. Application Data

(63) Continuation of application No. PCT/CN2020/088554, filed on May 2, 2020.

(30) Foreign Application Priority Data

May 5, 2019 (CN) ..... 201910366960.2
Dec. 30, 2019 (CN) ..... 201911390699.6

(51) Int. Cl.
*F28F 1/02* (2006.01)
*F28D 1/053* (2006.01)

(52) U.S. Cl.
CPC ..... *F28F 1/022* (2013.01); *F28D 1/05383* (2013.01)

(58) Field of Classification Search
CPC ..... F28F 1/022; F28D 1/05383
(Continued)

(56) References Cited

U.S. PATENT DOCUMENTS 4,570,700 A * 2/1986 Ohara ..... F28F 1/02 165/170
5,941,303 A * 8/1999 Gowan ..... F28F 9/0207 165/174

(Continued)

FOREIGN PATENT DOCUMENTS

CN 1363818 A 8/2002
CN 1153943 C 6/2004

(Continued)

*Primary Examiner* — Tho V Duong
*Assistant Examiner* — Raheena R Malik
(74) *Attorney, Agent, or Firm* — Cheng-Ju Chiang

(57) ABSTRACT

The present application discloses a microchannel flat tube and a microchannel heat exchanger. The microchannel flat tube includes a flat tube body and a row of channels. The flat tube body includes a first plane, a second plane, a first side surface and a second side surface. The first side surface and the second side surface are arranged on opposite sides of the flat tube body. The row of channels is arranged in the flat tube body. The row of channels extends through the flat tube body. The row of channels extends through the flat tube body. The row of channels at least includes a first channel, a second channel and a third channel which are arranged in a width direction. Cross-sectional areas of the first channel, the second channel and the third channel in the width direction change according to an exponential function.

15 Claims, 5 Drawing Sheets

(58) Field of Classification Search
USPC ..... 165/167
See application file for complete search history.

(56) References Cited

U.S. PATENT DOCUMENTS

| | | | | |
|---|---|---|---|---|
| 6,546,998 | B2 * | 4/2003 | Oh | F28D 1/0535 165/172 |
| 2002/0066554 | A1 * | 6/2002 | Oh | F28D 1/0535 165/172 |
| 2005/0051317 | A1 * | 3/2005 | Chin | F28F 1/022 165/177 |
| 2009/0166016 | A1 * | 7/2009 | Hu | F28D 1/0443 165/151 |
| 2012/0227945 | A1 * | 9/2012 | Taras | F28F 17/005 165/172 |
| 2013/0153174 | A1 * | 6/2013 | Taras | F28F 1/12 165/104.19 |
| 2014/0224462 | A1 * | 8/2014 | Kamada | F28F 1/128 165/181 |
| 2021/0033350 | A1 * | 2/2021 | Jiang | F28F 1/02 |
| 2021/0156622 | A1 * | 5/2021 | Jiang | F28F 1/022 |
| 2021/0262744 | A1 * | 8/2021 | Leffler | F25B 39/04 |

FOREIGN PATENT DOCUMENTS

| | | | |
|---|---|---|---|
| CN | 101526322 | A | 9/2009 |
| CN | 202630766 | U | 12/2012 |
| CN | 103038596 | A | 4/2013 |
| CN | 101825404 | B | 5/2013 |
| CN | 204665753 | U | 9/2015 |
| CN | 206847460 | U | 1/2018 |
| CN | 207963600 | U | 10/2018 |
| CN | 110017703 | A | 7/2019 |
| GB | 2133525 | A | 7/1984 |
| JP | H8-178366 | A | 7/1996 |
| JP | 2005-127597 | A | 5/2005 |
| WO | 2009/088796 | A3 | 7/2009 |
| WO | PCT/CN2020/088554 | | 5/2020 |

* cited by examiner

| serial number | 1 | 2 | 3 | 4 | 5 | 6 | 7 | 8 | 9 | 10 | 11 | 12 | 13 | 14 | 15 | 16 | 17 | 18 | 19 | 20 | 21 |
|---|---|---|---|---|---|---|---|---|---|---|---|---|---|---|---|---|---|---|---|---|---|
| hole width | 1.45 | 1.36 | 1.27 | 1.19 | 1.12 | 1.05 | 0.98 | 0.92 | 0.86 | 0.81 | 0.76 | 0.71 | 0.66 | 0.62 | 0.58 | 0.55 | 0.51 | 0.48 | 0.45 | 0.42 | 0.4 |
| round corner R | 0.3 | 0.3 | 0.3 | 0.3 | 0.3 | 0.3 | 0.2 | 0.2 | 0.2 | 0.2 | 0.2 | 0.2 | 0.2 | 0.2 | 0.2 | 0.2 | 0.1 | 0.1 | 0.1 | 0.1 | 0.1 |

FIG. 3

MICROCHANNEL FLAT TUBE AND MICROCHANNEL HEAT EXCHANGER

CROSS REFERENCE TO RELATED APPLICATIONS

The present application is a continuation application of International (PCT) Patent Application No. PCT/CN2020/088554, filed on May 2, 2020, which claims benefit of Chinese patent application No. 201910366960.2, filed on May 5, 2019, and Chinese patent application No. 201911390699.6, filed on Dec. 30, 2019, the disclosure of which is incorporated by reference herein.

TECHNICAL FIELD

The present application relates to a field of heat exchange technology, and specifically to a microchannel flat tube and a microchannel heat exchanger.

BACKGROUND

Micro-channel heat exchangers are heat exchange devices widely used in vehicle, household or commercial air-conditioning systems. The micro-channel heat exchanger can be used as an evaporator or a condenser in an air-conditioning system. The microchannel heat exchanger is a heat exchanger composed of flat tubes, fins, collecting pipes, etc. When wind generated by an external fan acts on microchannel fins and the flat tubes, a refrigerant in the flat tube flow channel of the microchannel heat exchanger exchanges heat with the air. Each flat tube of the micro-channel heat exchanger has a flow channel composed of multiple small holes side by side, and the refrigerant evaporates or condenses in the side-by-side flow channel of the flat tube. When used as a condenser, the refrigerant is cooled in the side-by-side flow channel of the flat tube. When used as an evaporator, the refrigerant is evaporated in the side-by-side flow channel of the flat tube.

In the flat tube used in the related art, multiple side-by-side flow channels are flow channels with the same cross-sectional area. When the wind flows through the heat exchanger, due to the existence of heat transfer between the wind and the refrigerant, each side-by-side flow channel has a different refrigerant temperature along a wind flow direction. Therefore, along a refrigerant flow direction, the refrigerant evaporates or condenses at different positions in the side-by-side flow channels. This leads to a mismatch between flow distribution of the refrigerant in the flow channels and heat exchange temperature difference, which reduces the heat exchange efficiency of the heat exchanger.

SUMMARY

According to an aspect of the present application, a microchannel flat tube is provided and includes:

a flat tube body including a first plane, a second plane, a first side surface and a second side surface, the first plane and the second plane being arranged on opposite sides of the flat tube body in a thickness direction, the first side surface and the second side surface being arranged on opposite sides of the flat tube body in a width direction, the first side surface connecting the first plane and the second plane, and the second side surface connecting the first plane and the second plane; and a row of channels extending through the flat tube body along the length direction, the row of channels at least including a first channel, a second channel and a third channel which are arranged along the width direction; wherein cross-sectional areas of the first channel, the second channel and the third channel along the width direction change according to an exponential function, or change according to a power function, or change according to a polynomial function.

According to an aspect of the present application, a microchannel heat exchanger is provided. The microchannel heat exchanger includes a first collecting pipe, a second collecting pipe, a plurality of microchannel flat tubes and fins. The plurality of microchannel flat tubes are connected side by side between the first collecting pipe and the second collecting pipe. The fins are sandwiched between two adjacent microchannel flat tubes. The row of channels communicates with an inner cavity of the first collecting pipe and an inner cavity of the second collecting pipe.

The cross-sectional areas of the first channel, the second channel and the third channel in the width direction of the microchannel flat tube of the present application change according to an exponential function, or change according to a power function, or change according to a polynomial function. This design can obtain channels with different flow cross-sectional areas. Therefore, the channels can be correspondingly arranged according to a wind direction, which is beneficial to improve the heat exchange efficiency of the microchannel flat tube and the microchannel heat exchanger during operation.

BRIEF DESCRIPTION OF DRAWINGS

FIG. 3 is a comparison table of relationships between channel widths, chamfer radiuses and channel numbers of channels of the microchannel flat tube shown in FIG. 2;

DETAILED DESCRIPTION

Figure 1:
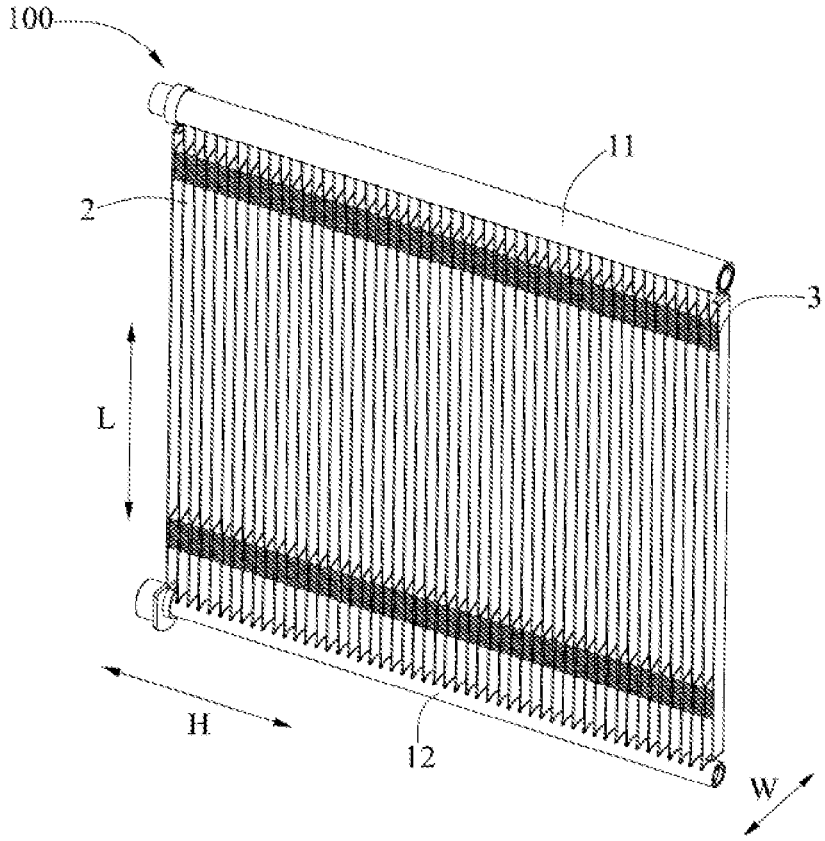
FIG. 1 is a schematic perspective view of a microchannel heat exchanger in accordance with an embodiment of the present application.
Figure 2:
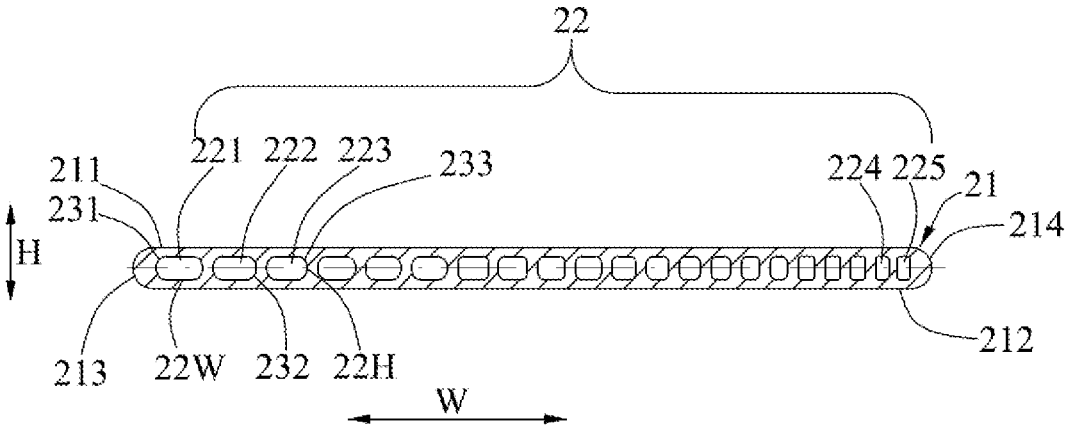
FIG. 2 is a schematic cross-sectional view of a microchannel flat tube shown in FIG. 1.
Figure 4:
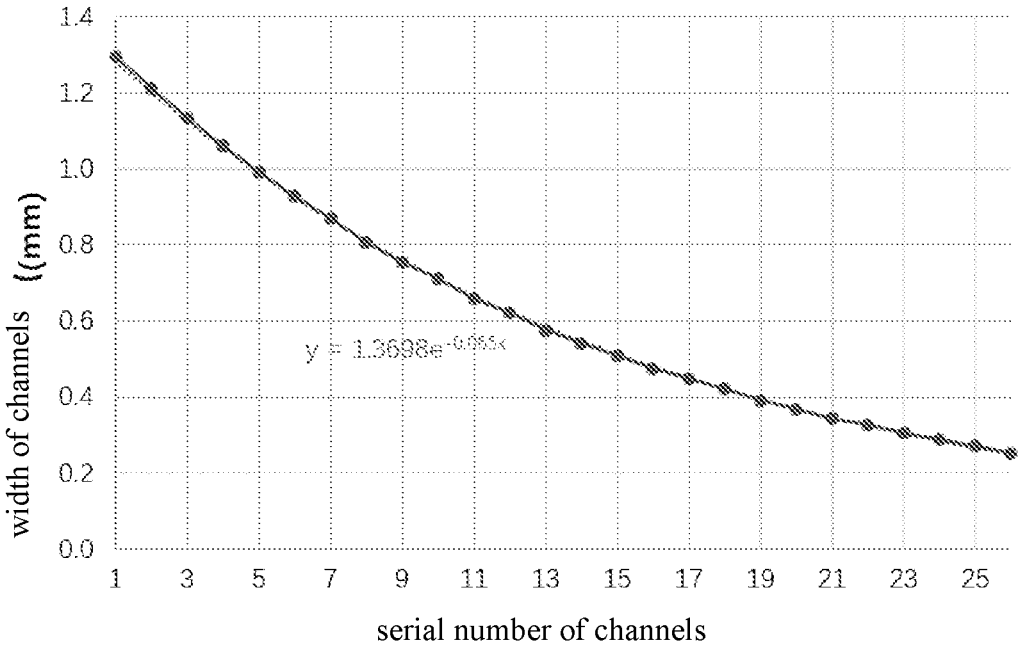
FIG. 4 is a schematic view showing relationships between the channel widths and the channel numbers of channels of the microchannel flat tube shown in FIG. 2.
Figure 5:
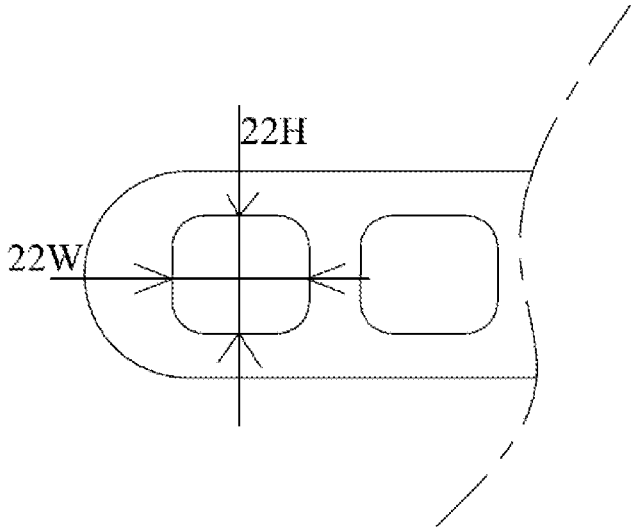
FIG. 5 is a partially enlarged schematic view of the microchannel flat tube shown in FIG. 2.

Here, exemplary embodiments will be described in detail, and examples thereof are shown in the drawings. When the following description refers to the drawings, unless otherwise indicated, same numbers in different drawings indicate the same or similar elements. The embodiments described in the following exemplary embodiments do not represent all implementation embodiments consistent with the present application. On the contrary, they are only examples of devices and methods consistent with some aspects of the present application as described in detail in the accompanying claims.

The terms used in the present application are only for the purpose of describing specific embodiments and are not intended to limit the present application. In the description of present application, it should be understood that the terms "center", "longitudinal", "transverse", "length", "width", "thickness", "upper", "lower", "front", "back", "left", "right", "vertical", "horizontal", "top", "bottom", "inner", "outer", "clockwise", "counterclockwise" and other directions or positional relationships are based on the orientation or positional relationships shown in the drawings. They are only for the convenience of describing the present application and simplifying the description, and do not indicate or imply that the device or element referred to must have a specific orientation, be constructed and operated in a specific orientation. Therefore, they cannot be understood as a restriction of the present application. In addition, the terms "first" and "second" are only used for descriptive purposes, and cannot be understood as indicating or implying relative importance or implicitly indicating the number of indicated technical features. Thus, the features defined with "first" and "second" may explicitly or implicitly include one or more of these features. In the description of present application, "a plurality of" means two or more than two, unless otherwise specifically defined.

In the description of present application, it should be noted that, unless otherwise clearly defined and limited, the terms "installation", "connection" and "communication" should be interpreted broadly. For example, it can be a fixed connection, a detachable connection or an integral connection. It can be a mechanical connection or an electrical connection. It can be a direct connection or an indirect connection through an intermediary. It can be a communication between two elements or an interaction between two elements. For those of ordinary skill in the art, the specific meanings of the above terms in present application can be understood according to specific circumstances.

In present application, unless expressly stipulated and defined otherwise, a first feature located "above" or "under" a second feature may include the first feature and the second feature are in direct contact, or may include the first feature and the second feature are not in direct contact but through other features between them. Moreover, the first feature located "above", "on top of" and "on" the second feature includes the first feature is located directly above and obliquely above the second feature, or it simply means that the level of the first feature is higher than the second feature. The first feature located "below", "at bottom of" and "under" the second feature includes the first feature is located directly below and obliquely below the second feature, or it simply means that the level of the first feature is lower than the second feature. The exemplary embodiments of the present application will be described in detail below with reference to the drawings. In the case of no conflict, the following embodiments and features in the embodiments can be mutually supplemented or combined.

The terms used in present application are only for the purpose of describing specific embodiments and are not intended to limit the application. The singular forms of "a", "said" and "the" used in present application and the appended claims are also intended to include plural forms, unless the context clearly indicates other meanings.

The exemplary embodiments of the present application will be described in detail below with reference to the drawings. In the case of no conflict, the following embodiments and features in the implementation can be combined with each other.

FIGS. 1 to 5 show a microchannel heat exchanger 100 in accordance with the present application. The microchannel heat exchanger 100 includes a first collecting pipe 11, a second collecting pipe 12, a plurality of microchannel flat tubes 2 and a plurality of fins 3. The plurality of microchannel flat tubes 2 are arranged parallel to each other, and are connected side by side between the first collecting pipe 11 and the second collecting pipe 12. Each fin 3 is sandwiched between two adjacent microchannel flat tubes 2.

The microchannel flat tube 2 includes a flat tube body 21 and a row of channels 22 extending through the flat tube body 21. A length of the flat tube body 21 is greater than a width of the flat tube body 21, and the width is greater than the thickness of the flat tube body 21. The flat tube body 21 includes a first plane 211, a second plane 212, a first side surface 213 and a second side surface 214. The first plane 211 and the second plane 212 are arranged on two opposite sides of the flat tube body 21 in a thickness direction H. The first side surface 213 and the second side surface 214 are disposed on two opposite sides of the flat tube body 21 in a width direction W. The first side surface 213 connects the first plane 211 and the second plane 212. The second side surface 214 connects the first plane 211 and the second plane 212. In this embodiment, the first side surface 213 and the second side surface 214 are arc-shaped. In other alternative embodiments, the first side surface 213 and the second side surface 214 may also be of flat or other shapes, as long as they serve to connect the first flat surface 211 and the second flat surface 214. The shapes in the present application are not limited to these described herein.

A row of channels 22 communicates with an inner cavity of the first collecting pipe 11 and an inner cavity of the second collecting pipe 12. The row of channels 22 is arranged in the flat tube body 21 along the width direction W. The row of channels 22 extends through the flat tube body 21 along a length direction L. The row of channels 22 extends through the flat tube body 21 along the length direction. The row of channels 22 at least includes a first channel 221, a second channel 222 and a third channel 223 which are arranged in the width direction. Cross-sectional areas of the first channel 221, the second channel 222 and the third channel 223 in the width direction change according to an exponential function, or change according to a power function, or change according to a polynomial function. In addition, perimeters, defined by the cross sectional areas, of the first channel 221, the second channel 222 and the third channel 223 also change according to an exponential function, or change according to a power function, or change according to a polynomial function. The first channel 221 is adjacent to the first side surface 213 and the third channel is adjacent to the second side surface 214. The first side surface 213 is a windward surface, and the second side surface 214 is a leeward surface. Therefore, when the refrigerant flows in the microchannel flat tube 2, the first channel 221 adjacent to the windward side has a larger flow cross-sectional area so that the heat exchange is more sufficient. The third channel 223 adjacent to the leeward side has a smaller flow area so that the heat exchange becomes smaller. Because the wind has been cooled after heat exchange on the windward side, the heat exchange capacity on the leeward side becomes smaller. At this time, the cross-sectional area of the channel on the leeward side is correspondingly reduced, so as to obtain a higher heat exchange efficiency within the same flat tube volume.

Each channel 22 includes a hole width 22W along the width direction W and a hole height 22H along the thickness direction H. The row of channels 22 includes a first channel 221, a second channel 222 and a third channel 223 which are arranged along the width direction. The hole heights 22H of the first channel 221, the second channel 222 and the third channel 223 are equal. The hole widths 22W of the first channel 221, the second channel 222 and the third channel 223 are decreased according to an exponential function, or changed according to a power function, or changed according to a polynomial function. Keeping the hole height 22H unchanged and gradually decreasing the hole width 22W according to the law, while ensuring the high heat exchange efficiency of the microchannel flat tube 2, the hole height of the microchannel flat tube 2 is lower and the microchannel flat tube 2 is thinner. As a result, the heat exchange efficiency is further improved. Alternatively, the change according to the exponential function is a change according to a natural exponential function.

Alternatively, the cross-sectional areas of the first channel 221, the second channel 222 and the third channel 223 meet a relationship: $y=S1x^6+S2x^5+S3x^4+S4x^3+S5x^2+S6x+S7$, or meet a relationship: $y=S8x^{S9}$, where x represents serial numbers of the channels, y represents the cross-sectional area of a corresponding channel, and S1, S2, S3, S4, S5, S6, S7, S8, S9 represent optional values. For example, the cross-sectional areas of the first channel 221, the second channel 222 and the third channel 223 meet a relationship: $y=0.0000006x^6-0.00005x^5+0.0015x^4-0.0245x^3+0.2162x^2-1.0246x+2.7442$. In the case where the hole heights 22H of the first channel 221, the second channel 222 and the third channel 223 remain the same, y may also represent the hole widths 22W of the first channel 221, the second channel 222 and the third channel 223.

Alternatively, the cross-sectional areas of the first channel 221, the second channel 222 and the third channel 223 meet a relationship: $y=me^{nx}$, where x represents the serial numbers of the channels, and y represents the cross-sectional area of the corresponding channel. Preferably, the cross-sectional areas of the first channel 221, the second channel 222 and the third channel 223 meet a relationship: $y=2.0995x^{-0.632}$. In the case where the hole heights 22H of the first channel 221, the second channel 222 and the third channel 223 remain the same, y may also represent the hole widths 22W of the first channel 221, the second channel 222 and the third channel 223.

Alternatively, a total width of the flat tube body 21 ranges from 20 mm to 30 mm, and the row of channels 22 includes thirty three channels. The cross-sectional areas of the first channel to the nineteenth channel which are arranged in the width direction meet a relationship: $y=S1x^6+S2x^5+S3x^4+S4x^3+S5x^2+S6x+S7$, or meet a relationship: $y=S8x^{S9}$, and the cross-sectional areas of the twentieth channel to the thirty-third channel are equal, where x represents the serial numbers of the channels, y represents the cross-sectional area of the corresponding channel, and S1, S2, S3, S4, S5, S6, S7, S8, S9 represent optional values. By making part of the holes of the lower hole widths adopt the same cross-sectional areas, it can reduce the manufacturing difficulty caused by the processing accuracy, and does not greatly affect the heat exchange efficiency.

Alternatively, the first channel, the second channel and the third channel meet a relationship: $y=S1x^5+S2x^4+S3x^3+S4x^2+S5x+S6$, where x represents the serial numbers of the channels, y represents the cross-sectional area of the corresponding channel, and S1, S2, S3, S4, S5, S6 represent optional values. In the case where the hole heights 22H of the first channel 221, the second channel 222 and the third channel 223 remain the same, y may also represent the hole widths 22W of the first channel 221, the second channel 222 and the third channel 223.

Alternatively, a total width of the flat tube body ranges from 15 mm to 25 mm, and the row of channels includes twenty three channels. The cross-sectional areas of the first channel to the nineteenth channel which are arranged in the width direction meet a relationship: $y=0.00005x^5+0.0007x^4-0.0159x^3+0.1698x^2-0.9141x+2.6628$, where x represents the serial numbers of the channels, y represents the cross-sectional area of the corresponding channel, and the cross-sectional areas of the twentieth channel to the twenty-third channel are equal. By making part of the holes of the lower hole widths adopt the same cross-sectional areas, it can reduce the manufacturing difficulty caused by the processing accuracy, and does not greatly affect the heat exchange efficiency. In the case where the hole heights 22H of the first channel 221, the second channel 222 and the third channel 223 remain the same, y may also represent the hole widths 22W of the first channel 221, the second channel 222 and the third channel 223.

Alternatively, a total width of the flat tube body is 25 mm, and the row of channels includes thirty three channels. The cross-sectional areas of the first channel to the nineteenth channel which are arranged in the width direction meet a relationship: $y=0.00005x^5+0.0007x^4-0.0159x^3+0.1698x^2-0.9141x+2.6628$, where x represents the serial numbers of the channels, y represents the cross-sectional area of the corresponding channel, and the cross-sectional areas of the twentieth channel to the thirty-third channel are equal. When the height is the same, y can also represent the width.

Alternatively, a total width of the flat tube body 21 ranges from 15 mm to 25 mm, and the row of channels 22 includes twenty three channels. The cross-sectional areas of the first channel to the nineteenth channel which are arranged in the width direction meet a relationship: $y=S1x^6+S2x^5+S3x^4+S4x^3+S5x^2+S6x+S7$, or meet a relationship: $y=S8x^{S9}$, and the cross-sectional areas of the twentieth channel to the twenty-third channel are equal, where x represents the serial numbers of the channels, y represents the cross-sectional area of the corresponding channel, and S1, S2, S3, S4, S5, S6, S7, S8, S9 represent optional values. When the height is the same, y can also represent the width.

Each of the cross-sectional areas of the first channel 221, the second channel 222 and the third channel 223 is of a rectangular shape with rounded corners. The first channel 221 includes four first chamfers 231. The second channel 222 includes four second chamfers 232. The third channel 223 includes four third chamfers 233. A radius of the first chamfer 231, a radius of the second chamfer 232 and a radius of the third chamfer 233 are equal or decreased in a fixed ratio. In this embodiment, the radius of the first chamfer 231, the radius of the second chamfer 232 and the radius of the third chamfer 233 are equal.

In an alternative embodiment of the present application, the width of the microchannel flat tube 2 is 20 mm to 30 mm. Preferably, the width of the microchannel flat tube 2 is 25.4 mm, and the thickness of the microchannel flat tube 2 is 1.3 mm. The first channel 221, the second channel 222, the third channel 233, the fourth channel 224, and the fifth channel 225 have the same hole height 22H which is 0.74 mm. A distance between all the channels 22 and the first plane 211 is 0.28 mm. A distance between all the channels 22 and the second plane 212 is 0.28 mm. The dimensions of the hole widths 22H of all the channels 22 from left to right are: 1.45 mm, 1.36 mm, 1.27 mm, 1.19 mm, 1.12 mm, 1.05 mm, 0.98 mm, 0.92 mm, 0.86 mm, 0.81 mm, 0.76 mm, 0.71 mm, 0.66 mm, 0.62 mm, 0.58 mm, 0.55 mm, 0.51 mm, 0.48 mm, 0.45 mm, 0.42 mm and 0.4 mm. In this way, the hole widths 22W of the row of channels 22 meet a relationship: $y=1.369e^{-0.065x}$, where x represents the serial numbers of the channels in the row of channels 22 from left to right, and y represents the hole width 22W of a corresponding x-th channel.

Of course, since the specific dimension of the hole width 22W exemplified in the present application is an alternative embodiment, other specific dimensions can also be selected, as long as the dimension of the hole width 22W of the row of channels 22 changes according to an exponential function in order. In addition, this curve change according to the exponential function can also be expressed by other polynomial functions: for example, $y=0.0017n^2-0.0879n+1.5227$, where n represents the serial numbers of the row of channels 22 from left to right, and y represents the hole width 22W of a corresponding n-th channel. As long as it conforms to a change similar to the polynomial functions, the present application is not limited thereto.

In addition, since the hole widths 22W of the channels adjacent to the second side surface 214 differ less than 0.03 mm, in order to avoid processing errors and processing accuracy which is not well controlled, several hole widths adjacent to the second side surface can also be set equal. For example, the hole widths 22W of the fourth channel 224 and the fifth channel 225 can be set equal, and the cross-sectional areas thereof are equal.

In an alternative embodiment of the present application, the chamfer radiuses of all the channels 22 are: 0.3 mm, 0.3 mm, 0.3 mm, 0.3 mm, 0.3 mm, 0.3 mm, 0.2 mm, 0.2 mm, 0.2 mm, 0.2 mm, 0.2 mm, 0.2 mm, 0.2 mm, 0.2 mm, 0.2 mm, 0.2 mm, 0.1 mm, 0.1 mm, 0.1 mm and 0.1 mm. A distance between adjacent channels 22 is 0.34 mm. Of course, the above-mentioned slight changes in dimensions due to processing errors are also within the protection scope of the present application.

In an alternative embodiment of the present application, the first side surface 213 of the microchannel flat tube 2 is a windward side, and the second side surface 214 of the microchannel flat tube 2 is a leeward side. That is to say, the channel cross sections of the microchannel flat tube 2 are decreased according to an exponential function along a direction of wind blowing or decreased according to a polynomial function, which is beneficial to improve the heat exchange performance of the heat exchanger 100.

Figure 6:
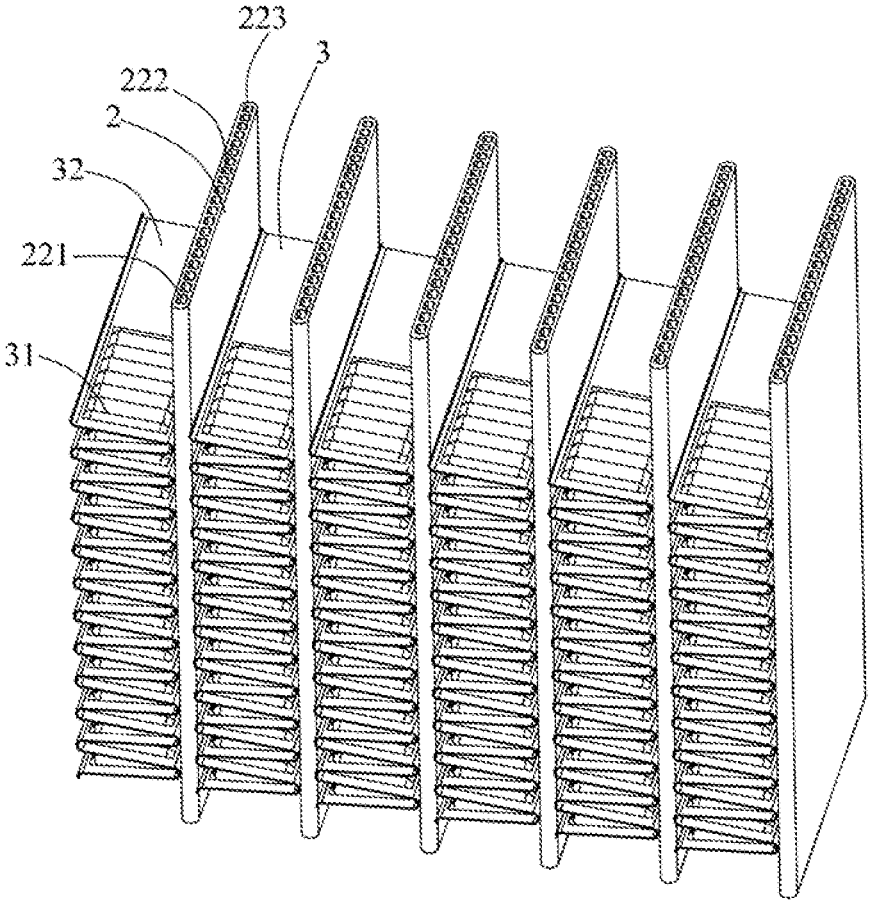
FIG. 6 is a schematic perspective view of microchannel flat tubes and fins in accordance with another embodiment of the present application.
Figure 7:
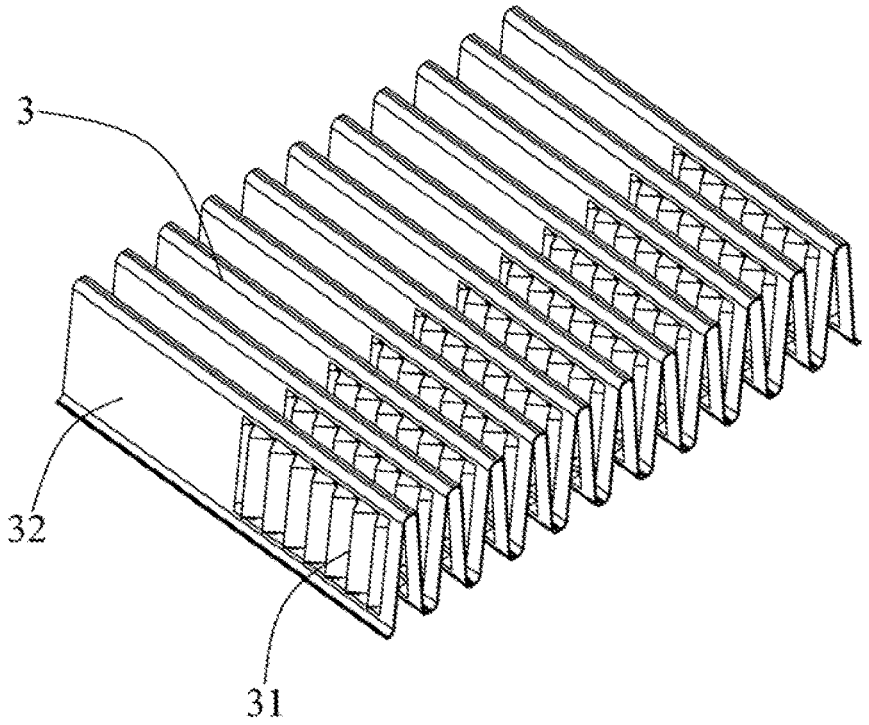
FIG. 7 is a schematic perspective view of the fins as shown in FIG. 6.
Figure 8:
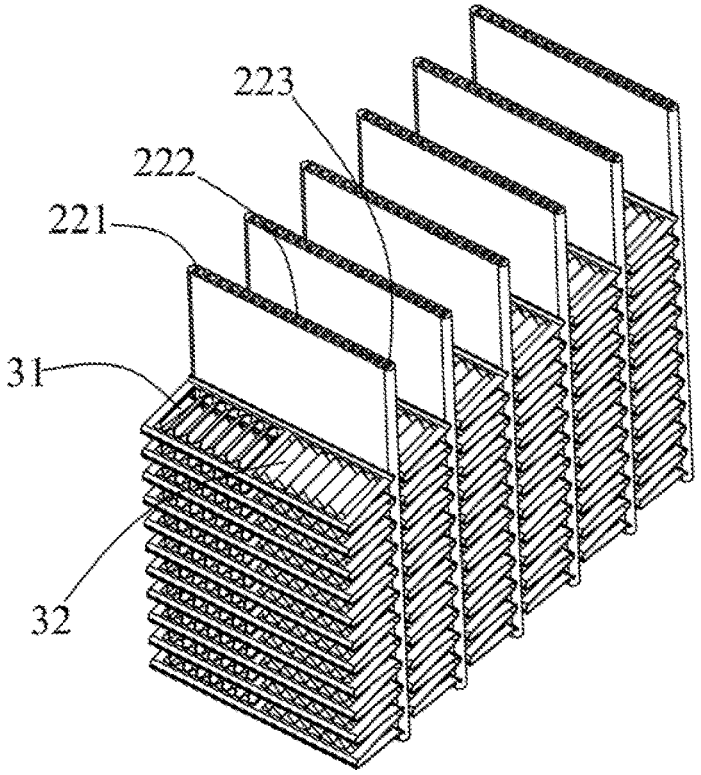
FIG. 8 is a schematic perspective view of microchannel flat tubes and fins in accordance with another embodiment of the present application.

As shown in FIGS. 6 and 7, the fin 3 includes a first portion 31 adjacent to the first channels 221 and a second portion 32 adjacent to the third channels 223. The shape of the first portion 31 is different from that of the second portion 32. The fin 3 is a louver fin, the first portion 31 is windowed, and the second portion 32 is not windowed. Openings of the first portion 31 can increase the turbulence on the windward side, thereby enhancing the heat exchange near the first channels 221. The unopened second portion 32 decreases the turbulence near the leeward side, thereby reducing the wind resistance and reducing the heat exchange of the third channels 223 near the leeward side. As a result, the overall heat exchange effect is improved and the wind resistance is reduced, which is beneficial to improve the heat exchange efficiency of the heat exchanger. Of course, as shown in FIG. 8, in other embodiments, the opening density of the first portion 31 is greater than the opening density of the second portion 32 to achieve the above-mentioned function of improving the heat exchange efficiency of the heat exchanger.

When the heat exchanger is working, wind generated by an external fan passes through the first side surface 213 adjacent to the first channels 221, passes through the fins 3, and then flows out from a position adjacent to the third channels 223. Therefore, when the refrigerant flows in the microchannel flat tubes 2, the first channels 221 adjacent to the windward side has a larger flow cross-sectional area so that the heat exchange is more sufficient. The third channels 223 adjacent to the leeward side have smaller flow areas so that the heat exchange is reduced. Because the wind has been cooled after heat exchange on the windward side, the heat exchange capacity on the leeward side becomes smaller. At this time, the cross-sectional area of the channels on the leeward side is correspondingly reduced, so that a higher heat exchange efficiency is obtained within the same flat tube volume, and the heat exchange efficiency of the microchannel heat exchanger is improved.

The foregoing descriptions are only preferred embodiments of the present application, and do not impose any formal limitations on the present application. Although the preferred embodiments of the present application have been disclosed as above, it is not intended to limit the present application. Those skilled in the art, without departing from the content of the technical solution of the present application, can use the technical content disclosed above to make some changes or modification into equivalent embodiments with equivalent changes. But any simple amendments, equivalent changes and modifications made to the above embodiments based on the technical essence of the application without departing from the content of the technical solution of the application are still within the scope of the technical solution of the present application.

What is claimed is:

1. A microchannel flat tube comprising:

a flat tube body comprising a first plane, a second plane, a first side surface and a second side surface, the first plane and the second plane being arranged on two opposite sides of the flat tube body in a thickness direction, the first side surface and the second side surface being arranged on two opposite sides of the flat tube body in a width direction, the first side surface connecting the first plane and the second plane, and the second side surface connecting the first plane and the second plane; and a row of channels extending through the flat tube body along the length direction, the row of channels at least comprising a first channel, a second channel and a third channel which are arranged along the width direction, wherein cross-sectional areas of the first channel, the second channel and the third channel along the width direction meet a relationship: $y=S1x^6+S2x^5+S3x^4+S4x^3+S5x^2+S6x+S7$, or meet a relationship: $y=S8x^{S9}$, where x represents serial numbers of the channels, y represents the cross-sectional area of a corresponding channel, and S1, S2, S3, S4, S5, S6, S7, S8, S9 represent optional values;

wherein a total width of the flat tube body ranges from 15 mm to 25 mm, and the row of channels comprises twenty three channels; and wherein the cross-sectional areas of the first channel to the nineteenth channel arranged along the width direction meet a relationship: $y=S1x^6+S2x^5+S3x^4+S4x^3+S5x^2+S6x+S7$ or meet a relationship: $y=S8x^{S9}$, and areas or widths of the twentieth channel to the twenty-third channel are equal, where x represents serial numbers of the channels, y represents the cross-sectional area of a corresponding channel, and S1, S2, S3, S4, S5, S6, S7, S8, S9 represent optional values.

2. The microchannel flat tube according to claim 1, wherein the cross-sectional areas of the first channel, the second channel and the third channel meet a relationship: $y=0.0000006x^6-0.00005x^5+0.0015x^4-0.0245x^3+0.2162x^2-1.0246x+2.7442$, or meet a relationship: $y=2.0995x^{-0.632}$, where x represents the serial numbers of the channels, and y represents the cross-sectional area of the corresponding channel.

3. The microchannel flat tube according to claim 1, wherein a total width of the flat tube body is 25 mm, and the row of channels comprises thirty three channels; and wherein the cross-sectional areas of the first channel to the nineteenth channel which are arranged along the width direction meet a relationship: $y=0.00005x^5+0.0007x^4-0.0159x^3+0.1698x^2-0.9141x+2.6628$, where x represents serial numbers of the channels, and y represents the cross-sectional area of a corresponding channel, and the cross-sectional areas of the twentieth channel.

4. The microchannel flat tube according to claim 1, wherein each cross-sectional area of the first channel, the second channel and the third channel is of a rectangular shape with rounded corners; the first channel comprises four first chamfers, the second channel comprises four second chamfers, and the third channel comprises four third chamfers.

5. The microchannel flat tube according to claim 4, wherein a radius of the first chamfer, a radius of the second chamfer and a radius of the third chamfer are equal or decreased at a fixed ratio.

6. The microchannel flat tube according to claim 1, wherein a distance between the first channel and the second channel is equal to a distance between the second channel and the third channel.

7. A microchannel flat tube comprising:

a flat tube body comprising a first plane, a second plane, a first side surface and a second side surface, the first plane and the second plane being arranged on two opposite sides of the flat tube body in a thickness direction, the first side surface and the second side surface being arranged on two opposite sides of the flat tube body in a width direction, the first side surface connecting the first plane and the second plane, and the second side surface connecting the first plane and the second plane; and a row of channels extending through the flat tube body along the length direction, the row of channels at least comprising a first channel, a second channel and a third channel which are arranged along the width direction, wherein cross-sectional areas of the first channel, the second channel and the third channel along the width direction meet a relationship: $y=S1x^5+S2x^4+S3x^3+S4x^2+S5x+S6$, where x represents serial numbers of the channels, y represents the cross-sectional area of a corresponding channel, and S1, S2, S3, S4, S5, S6 represent optional values;

wherein the row of channels further comprises a fourth channel and a fifth channel arranged along the width direction; the first channel is adjacent to the first side surface, the fifth channel is adjacent to the second side surface, the fourth channel is located between the third channel and the fifth channel, and cross-sectional areas of the fourth channel and the fifth channel along the width direction are equal.

8. The microchannel flat tube according to claim 7, wherein a total width of the flat tube body ranges from 15 mm to 25 mm, and the row of channels comprises twenty three channels; and wherein the cross-sectional areas or widths of the first channel to the nineteenth channel which are arranged along the width direction meet a relationship: $y=0.00005x^5+0.0007x^4-0.0159x^3+0.1698x^2-0.9141x+2.6628$, where x represents the serial numbers of the channels, and y represents the cross-sectional area of the corresponding channel, and the cross-sectional areas of the twentieth channel to the twenty-third channel are equal.

9. A microchannel heat exchanger comprising microchannel flat tubes, a first collecting pipe, a second collecting pipe and fins;

the microchannel flat tube comprising a flat tube body and a row of channels;

the flat tube body comprising a first plane, a second plane, a first side surface and a second side surface, the first plane and the second plane being disposed on two opposite sides of the flat tube body in a thickness direction, the first side surface and the second side surface being arranged on two opposite sides of the flat tube body in the width direction, the first side surface connecting the first plane and the second plane, and the second side surface connecting the first plane and the second plane;

the row of channels extending through the flat tube body along a length direction, and the row of channels at least comprising a first channel, a second channel and a third channel arranged along the width direction; wherein cross-sectional areas of the first channel, the second channel and the third channel along the width direction change according to an exponential function, or change according to a power function, or change according to a polynomial function; and wherein the microchannel flat tubes are connected side by side between the first collecting pipe and the second collecting pipe, each fine is sandwiched between two adjacent microchannel flat tubes, and the row of channels communicates with an inner cavity of the first collecting pipe and an inner cavity of the second collecting pipe;

wherein the row of channels further comprises a fourth channel and a fifth channel arranged along the width direction; the first channel is adjacent to the first side surface, the fifth channel is adjacent to the second side surface, the fourth channel is located between the third channel and the fifth channel, and cross-sectional areas of the fourth channel and the fifth channel along the width direction are equal.

10. The microchannel heat exchanger according to claim 9, wherein each fine comprises a first portion adjacent to the first channel and a second portion adjacent to the third channel, and the first portion and the second portion have different shapes.

11. The microchannel heat exchanger according to claim 10, wherein the fins are louvered fins, the first portion is windowed, and the second portion is not windowed.

12. The microchannel heat exchanger according to claim 9, wherein each fine comprises a first portion adjacent to the first channel and a second portion adjacent to the third channel; and wherein an opening density of the first portion is different from an opening density of the second portion; and wherein the opening density of the first portion is greater than the opening density of the second portion.

13. The microchannel heat exchanger according to claim 9, wherein the first channel is adjacent to the first side surface, and the third channel is adjacent to the second side surface; and wherein when the microchannel heat exchanger is working, wind generated by an external fan passes through the first side surface adjacent to the first channel, passes through the fins, and then flows out from a position adjacent to the third channel.

14. The microchannel heat exchanger according to claim 9, wherein the cross-sectional areas of the first channel, the second channel and the third channel meet a relationship: $y=S1x^6+S2x^5+S3x^4+S4x^3+S5x^2+S6x+S7$, or meet a relationship: $y=S8x^{S9}$, where x represents serial numbers of the channels, y represents the cross-sectional area of a corresponding channel, and S1, S2, S3, S4, S5, S6, S7, S8, S9 represent optional values.

15. The microchannel heat exchanger according to claim 9, wherein the cross-sectional areas of the first channel, the second channel and the third channel meet a relationship: $y=S1x^5+S2x^4+S3x^3+S4x^2+S5x+S6$, where x represents serial numbers of the channels, y represents the cross-sectional area of a corresponding channel, and S1, S2, S3, S4, S5, S6 represent optional values.

* * * * *